US011234301B2

(12) United States Patent
Hung et al.

(10) Patent No.: US 11,234,301 B2
(45) Date of Patent: Jan. 25, 2022

(54) CONTROL CIRCUIT AND LIGHTING DEVICE WITH CONTROL CIRCUIT

(71) Applicant: CHAMP TECH OPTICAL (FOSHAN) CORPORATION, Foshan (CN)

(72) Inventors: Chin-Che Hung, Tu-Cheng (TW); Chun-Chi Chen, New Taipei (TW); Jian-Hong Hu, Foshan (CN); Wei Yuan, Foshan (CN); Ai-Hua Li, Foshan (CN)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 88 days.

(21) Appl. No.: 16/852,765

(22) Filed: Apr. 20, 2020

(65) Prior Publication Data

US 2020/0253016 A1 Aug. 6, 2020

(30) Foreign Application Priority Data

Apr. 10, 2020 (CN) ..... 202010280633.8

(51) Int. Cl.

| | |
|---|---|
| ***H05B 45/20*** | (2020.01) |
| ***H05B 45/37*** | (2020.01) |
| ***H05B 45/50*** | (2020.01) |
| ***H05B 45/34*** | (2020.01) |
| ***H05B 45/10*** | (2020.01) |
| ***H05B 45/325*** | (2020.01) |

(52) U.S. Cl.

CPC ..... *H05B 45/20* (2020.01); *H05B 45/10* (2020.01); *H05B 45/34* (2020.01); *H05B 45/37* (2020.01); *H05B 45/50* (2020.01); *H05B 45/325* (2020.01)

(58) Field of Classification Search

CPC ..... H05B 47/185; H05B 45/3725; H05B 45/375; H05B 45/382; H05B 45/56; H05B 47/19; H05B 45/28; H05B 47/25; H05B 45/20; H05B 47/165; H05B 47/175; H05B 45/10; H05B 45/325; H05B 45/34; H05B 45/37; H05B 45/46; H05B 45/50

See application file for complete search history.

(56) References Cited

U.S. PATENT DOCUMENTS

| | | | | |
|---|---|---|---|---|
| 9,119,245 | B1 * | 8/2015 | Yang | H05B 45/10 |
| 2013/0249429 | A1 * | 9/2013 | Woytowitz | H05B 47/185 315/246 |
| 2015/0237700 | A1 * | 8/2015 | Woytowitz | H05B 45/28 315/307 |
| 2019/0313503 | A1 * | 10/2019 | Woytowitz | H05B 47/19 |

FOREIGN PATENT DOCUMENTS

| | | | |
|---|---|---|---|
| TW | 201509229 | A | 3/2015 |
| TW | 201605289 | A | 2/2016 |

* cited by examiner

*Primary Examiner* — Monica C King
(74) *Attorney, Agent, or Firm* — ScienBiziP, P.C.

(57) ABSTRACT

A lighting device which is controllable in respect of color temperature as well as brightness has a control circuit electrically coupled to AC voltage source. The control circuit includes first and second control circuits, the first control circuit turns the light emitting device on and off and adjusts brightness of the light emitting device. The second control circuit determines whether the AC voltage source is on during a predetermined period, and if determined to be on, adjusts color temperature of the light emitting device.

14 Claims, 3 Drawing Sheets

CONTROL CIRCUIT AND LIGHTING DEVICE WITH CONTROL CIRCUIT

CROSS-REFERENCE TO RELATED APPLICATIONS

This application claims priority to Chinese Patent Application No. 202010280633.8 filed on Apr. 10, 2020, the contents of which are incorporated by reference herein.

FIELD

The subject matter herein generally relates to lighting field.

BACKGROUND

Existing LED lighting equipment is relatively simple in function. The LED lighting device usually has a single function of turning on and turning off and controlling a certain color temperature in the LED lamps. To produce a cold white light or a warm white light, more devices may be necessary.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
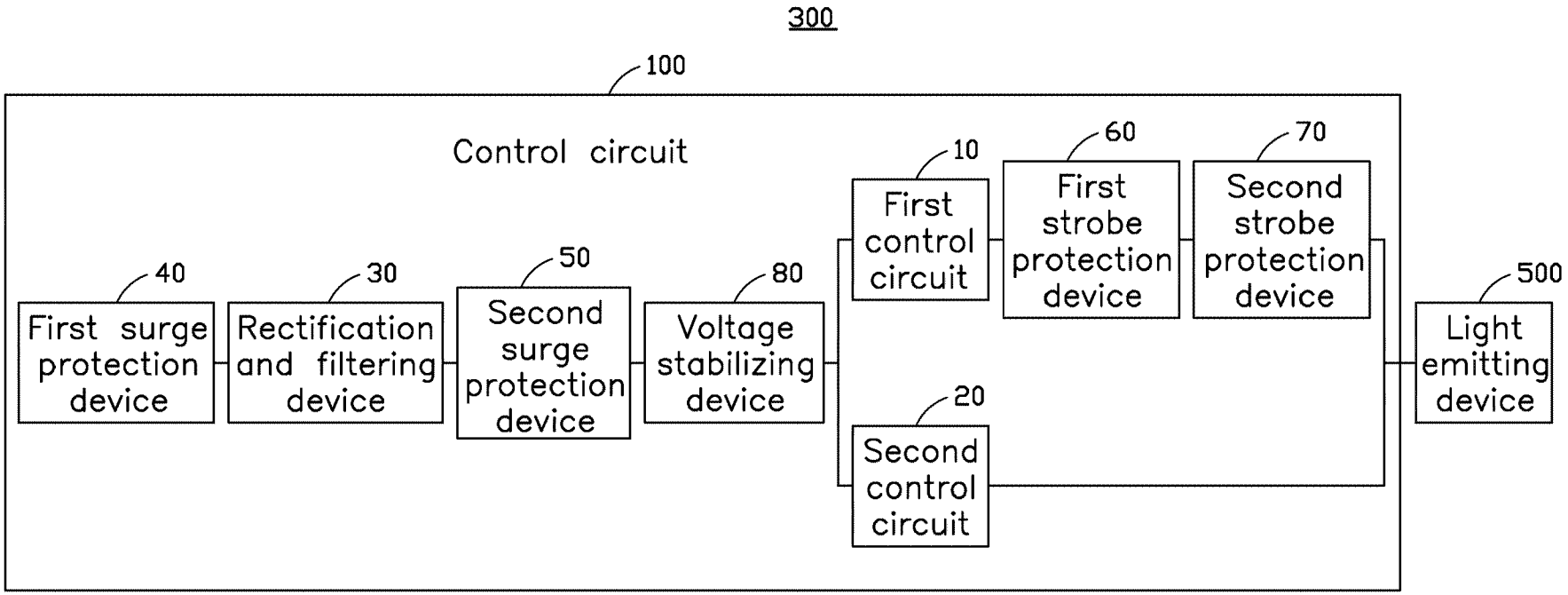
FIG. 1 is a block diagram of one embodiment of a lighting device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The present disclosure, including the accompanying drawings, is illustrated by way of examples and not by way of limitation. It should be noted that references to "an" or "one" embodiment in this disclosure are not necessarily to the same embodiment, and such references mean "at least one."

The term "comprises" means "including, but not necessarily limited to"; it specifically indicates open-ended inclusion or membership in a so-described combination, group, series, and the like.

FIG. 1 illustrates an application environment architecture diagram of a lighting device. Depending on the embodiment, the lighting device 300 can include a control circuit 100, and a light emitting device 500 which is electrically coupled to the control circuit 100.

In at least one embodiment, the control circuit 100 can control the light emitting device 500 to emit light, and the control circuit 100 is electrically coupled to AC voltage source. The control circuit 100 can include a first control circuit 10 and a second control circuit 20. The first control circuit 10 is electrically coupled to the light emitting device 500. The first control circuit 10 can control the light emitting device 500 to turn on or turn off, and further can adjust brightness of the light emitting device 500. The second control circuit 20 is also electrically coupled to the light emitting device 500. Within a predetermined period, the second control circuit 20 can detect state of the AC voltage source and adjust color temperature of the light emitting device 500 when detecting that the AC voltage source is on.

Figure 2:
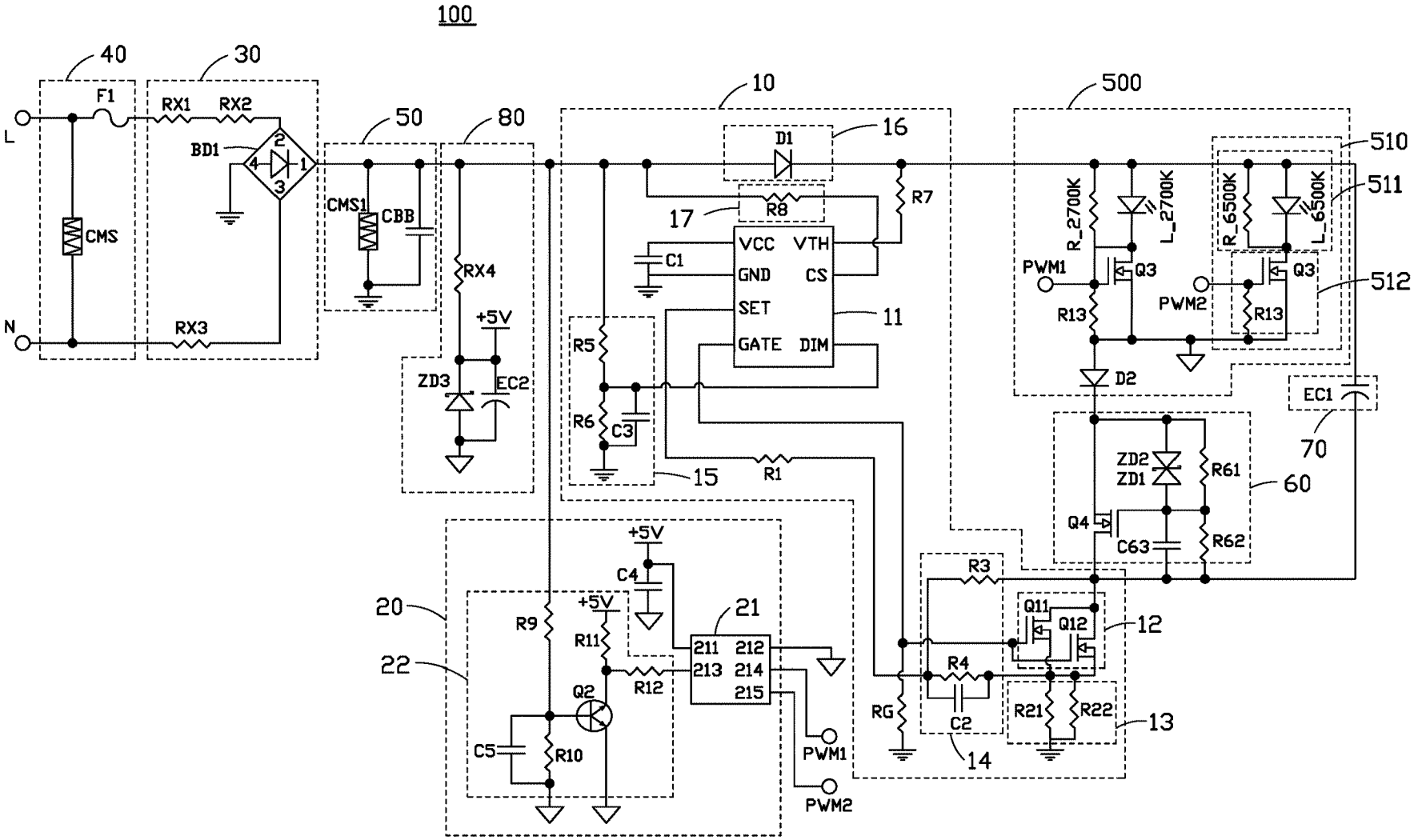
FIG. 2 is a circuit diagram of the lighting device of FIG. 1.

Referring to FIG. 2, the first control circuit 10 can include a first chip 11, a switch 12, and a first adjusting device 13. The first chip 11 can include a first power pin VCC, a first ground pin GND, a set pin SET, and a gate input pin GATE.

In at least one embodiment, the first power pin VCC is grounded through a first capacitor C1, the first ground pin GND is grounded. The gate input pin GATE is electrically coupled to the light emitting device 500 through the switch 12, and the gate input pin GATE can control the light emitting device 500 to turn on or off by the switch 12. The set pin SET is electrically coupled to the switch 12 through the first adjusting device 13, and thereby can adjust input current of the light emitting device 500.

In at least one embodiment, the switch 12 can include at least one first switch. In one embodiment, the switch 12 can include a first switch Q11 and a first switch Q12. A first terminal of the at least one first switch is electrically coupled to the gate input pin GATE, and a second terminal of the at least one first switch is electrically coupled to the light emitting device 500, and a third terminal of the at least one first switch is grounded through the first adjusting device 13. When the switch 12 is turned on, the light emitting device 500 is turned on, and when the switch 12 is turned off, the light emitting device 500 is turned off. The number of the first switches can be increased or decreased according to actual needs, wherein increasing the number of the first switches can reduce the power consumption of a single first switch, thereby solving heat dissipation problems.

In at least one embodiment, the first adjusting device 13 can include a first resistor R1, and at least one second resistor which is corresponding to the at least one first switch. In one embodiment, the first adjusting device 13 can include a second resistor R21 and a second resistor R22. One end of the first resistor is electrically coupled to the set pin SET, and the other end of the first resistor is grounded through the at least one second resistor. One end of each second resistor of the at least one second resistor is electrically coupled to the corresponded at least one switch, and the other end of each second resistor of the at least one second is grounded. The first adjusting device 13 can adjust brightness of the light emitting device 500 by changing the input current of the light emitting device 500, and the input current of the light emitting device 500 is changed by adjusting resistance of the at least one second resistor.

In at least one embodiment, the first control circuit 10 further can include an overvoltage protection device 14. The overvoltage protection device 14 is located between the set pin SET and the first adjusting device 13, and is electrically coupled to the light emitting device 500. The overvoltage protection device 14 protects the light emitting device 500 against a voltage larger than a predetermined value. In at least one embodiment, the overvoltage protection device 14 can include a third resistor R3, a fourth resistor R4 and a second capacitor C2. One end of the third resistor R3 and the fourth resistor R4 coupled in series is electrically coupled to the light emitting device 500, and the other end is electrically coupled to the switch. The second capacitor C2 is electrically coupled to the fourth resistor R4.

In at least one embodiment, the first control circuit 10 further can include an input device 15. The first chip 11 further can include a dimming pin DIM which is electrically coupled to the input device 15. The dimming pin DIM can obtain a stable voltage through the input device 15. The input device 15 can include a fifth resistor R5, a sixth resistor R6, and a third capacitor C3. One end of the fifth resistor R5 and the sixth resistor R6 coupled in series is electrically coupled to the AC voltage source, and the other end is grounded. The third capacitor C3 is coupled in parallel to the sixth resistor R6. The dimming pin DIM is electrically coupled between the fifth resistor R5 and the sixth resistor R6.

In at least one embodiment, the first control circuit 10 further can include a reverse current protection circuit 16. The first chip 11 further can include a protection pin VTH. The reverse current protection circuit 16 can include a first diode D1. One end of the first diode D1 is electrically coupled to the AC voltage source, and the other end is electrically coupled to the protection pin VTH through a seventh resistor R7, and at the same time, the other end is electrically coupled to the light emitting device 500.

In at least one embodiment, the first control circuit 10 further can include a second adjusting device 17. The second adjusting device 17 can include an eighth resistor R8. The first chip 11 further can include a protection pin CS, which is electrically coupled to the AC voltage source through the eighth resistor R8.

In at least one embodiment, the first control circuit 10 further can include an EMI protection resistor RG. One end of the EMI protection resistor RG is electrically coupled to between the gate input pin GATE and the first switches Q11 and Q21, and the other end is grounded. The EMI protection resistor RG provides EMI protection for the first switches Q11 and Q21.

In at least one embodiment, the second control circuit 20 can include a second chip 21 and a detection device 22. The second chip 21 can include a second power pin 211, a second ground pin 212, a detection pin 213, a first output pin 214, and a second output pin 215. The second power pin 211 is electrically coupled to a power source, in the preferred embodiment, it is a 5V power source. The second power pin 211 is also grounded via a fourth capacitor C4. The second ground pin 212 is grounded. The detection pin 213 is electrically coupled to the AC voltage source. If the detection pin 213 detects that the AC voltage source is turned on, or if the detection pin detects that a voltage value of the AC voltage source is equal to a predetermined value, the detection device 22 can send a detection signal to the detection pin 213, and the detection signal can trigger the first output pin 214 to output a first pulse signal to the light emitting device 500. The second output pin 215 can output a second pulse signal to the light emitting device 500 to adjust color temperature by the first and second pulse signals.

In at least one embodiment, the second chip 21 is a chip with EEPROM programmable and read program memory, which stores multiple sets of color temperature adjustment programs, and each set of programs can produce a different color temperature. Preferably, the second chip 21 can store three to six sets of color temperature adjustment programs. Each set of color temperature adjustment programs can control the first output pin 214 and the second output pin 215 to output a first pulse signal and a second pulse signal with different duty ratios, so that the light emitting device 500 emits lights of different color temperatures In at least one embodiment, the detection device 22 can include a ninth resistor R9, a tenth resistor R10, a fifth capacitor C2, and a second switch Q2. One end of the ninth resistor R9 and tenth resistor R10 coupled in series is electrically coupled to the AC voltage resource, and the other end is grounded. The fifth capacitor C5 is coupled in parallel to the tenth resistor R10. A first terminal of the second switch Q2 is electrically coupled between the ninth resistor R9 and the tenth resistor R10, a second terminal of the second switch Q2 is electrically coupled to the power source through an eleventh resistor R11, and electrically coupled to the detection pin 213 through a twelve resistor R12. A third terminal of the second switch Q2 is grounded. If a voltage value of the AC voltage source is equal to a predetermined value, the second switch is turned on to send the detection signal to the detection pin 213.

In at least one embodiment, the control circuit 100 further can include a rectification and filtering device 30, which is disposed between the AC voltage source and the first control circuit 10 and the second control circuit 20. The rectification and filtering device 30 rectifies and filters the AC voltage source, and outputs driving current to the first control circuit 10, the second control circuit 20, and the light emitting device 500.

In at least one embodiment, the rectification and filtering device 30 can include a voltage dividing resistor RX1, a second voltage dividing resistor RX2, a third voltage dividing resistor RX3, and a rectifier bridge BD1. A first terminal of the rectifier bridge BD1 is electrically coupled to the first control circuit 10, the first control circuit 20, and the light emitting device 500, to output the driving current. A second terminal of the rectifier bridge BD1 is electrically coupled to a first end L of the AC voltage source through the voltage dividing resistor RX1 and the second voltage dividing resistor RX2 which are coupled in series. A third terminal of the rectifier bridge BD1 is electrically coupled to a second end N of the AC voltage source through the third voltage dividing resistor RX3. A fourth terminal of the rectifier bridge BD1 is grounded.

It can be understood that the control circuit 100 further includes a first surge protection device 40 and a second surge protection device 50 which are disposed on both sides of the rectification and filtering device 30 to prevent the control circuit 100 from being subjected to EMI electromagnetic interference and to suppress lightning surges. The first surge protection device 40 can provide transient state protection and the second surge protection device 40 can provide steady state protection.

In at least one embodiment, the first surge protection device 40 can include a fuse F1 and a first varistor CMS. The first varistor CMS is electrically coupled to the first end L and the second end N of the AC voltage source, and the fuse F1 is electrically coupled to the first end L and the rectifying and filtering device 30.

In at least one embodiment, the second surge protection device 50 can include a second varistor CMS1 and a filter capacitor CBB which are coupled in parallel. One end of the parallel second varistor CMS1 and filter capacitor CBB is electrically coupled to the rectifier filter device 30, and the other end is grounded.

In at least one embodiment, the control circuit 100 further can include a first strobe protection device 60 which is electrically coupled between the first control circuit 10 and the light emitting device 500. The first strobe protection device 60 prevents the light emitting device 500 from generating strobes.

In at least one embodiment, the first strobe protection device 60 can include a fourth switch Q4, a first zener diode ZD1, a second zener diode ZD2, a first protection resistor R61, a second protection resistor R62, and a protection capacitor C63.

In at least one embodiment, A first terminal of the fourth switch Q4 is electrically coupled to the light emitting device 500 through the first zener diode ZD1 and the second zener diode ZD2. A second terminal of the fourth switch Q4 is e electrically coupled to the light emitting device 500, and a third terminal of the fourth switch Q4 is electrically coupled to the first control circuit 10. An anode of the first zener diode ZD1 is electrically coupled to the first terminal of the fourth switch Q4, and a cathode of the first zener diode ZD1 is electrically coupled to a cathode of the second zener diode ZD2. An anode of the second voltage stabilizing diode ZD2 is electrically coupled to the second terminal of the fourth switch Q4. The first protection resistor R61 is coupled in parallel to the first terminal and the second terminal of the fourth switch Q4. The first protection resistor R61 and the protection capacitor C63 are coupled in parallel to the second terminal and the third terminal of the fourth switch Q4.

In at least one embodiment, the control circuit 100 further can include a second strobe protection device 70 which is electrically coupled between the first control circuit 10 and the light emitting device 500. The second strobe protection device 70 prevents strobing by the light emitting device 500.

In at least one embodiment, the second strobe protection device 70 can include a first polarized capacitor EC1.

In at least one embodiment, the control circuit 100 further can include a voltage stabilizing device 80 which is electrically coupled between the AC voltage source and the first control module 10 and the second control module 20. The voltage stabilizing device 80 provides a stable voltage input from the AC voltage source to the first control circuit 10, the second control circuit 20 and the light emitting device 500.

In at least one embodiment, the voltage stabilizing device 80 can include a fourth voltage dividing resistor RX4, a third voltage stabilizing diode ZD3, and a second polarized capacitor EC2. One end of the fourth voltage dividing resistor RX4 is electrically coupled to the AC voltage source, the other end is electrically coupled to a anode of the third voltage stabilizing diode ZD3, a cathode of the third voltage stabilizing diode ZD3 is grounded, and the second polarized capacitor EC2 is coupled in parallel to the third zener diode ZD3.

In at least one embodiment, the light emitting device 500 can include two light emitting units 510. Each light emitting unit 510 can include a light emitting element 511 and a switch circuit 512. The switch circuit 512 can include a third switch Q3. A first terminal of the third switch Q3 is electrically coupled to the light emitting element 511, a second terminal of the third switch Q3 is electrically coupled to the first output pin 214 and the second output pin 215 of the second control circuit 20, and a third terminal of the third switch Q3 is grounded through the thirteenth resistor R13. The third terminal of the third switch Q3 is electrically coupled to the switch 12 of the first control circuit 10. In one embodiment, the light respectively emitted by the two light emitting units 510 has the original first color temperature and a second color temperature.

When the lighting device 300 is in operation, the first surge protection device 40 is electrically coupled to the first end L and the second end N of the AC voltage source. The AC voltage source can be output to the first controlling device 10, the second controlling device 20, and the light emitting device 500, after being rectified and filtered by the rectification and filtering device 30 and being stabilized by the voltage regulation device 80. The first control circuit 10 can control the light emitting device 500 to turn on through the switch 12, and adjust the brightness of the light emitting device 500 by adjusting the resistance of the second resistors R21 and R22. When the AC voltage source is disconnected, the first control circuit 10 can control the light emitting device 500 to turn off through the switch 12. The second control device 20 can detect the state of the AC voltage source within a predetermined time, and adjust the color temperature of the light emitting device 500 when detecting that the AC voltage source is on.

In at least one embodiment for example, the second chip 21 can store three sets of color temperature adjustment programs. Among the three sets of color temperature adjustment programs, the first set of color temperature adjustment programs makes the ratio of color temperatures of the light emitted by the two light emitting units 510 to be 100% and 0, respectively. That is, only one of the light emitting units 510 emits light with the first color temperature, for example, 2700K. The second set of color temperature adjustment programs makes the ratio of color temperatures of the light emitted by the two light emitting units 510 to be 100% and 0, respectively. That is, only one of the light emitting units 510 emits light with the second color temperature, for example, 5000K. The third set of color temperature adjustment programs makes the ratio of color temperatures of the light emitted by the two light emitting units 510 to be 80% and 20%, respectively. That is, only one of the light emitting units 510 emits light with the first color temperature, for example, 2700K. One of the light emitting units 210 emits light with a first color temperature of 80%, and the other light emitting unit 510 emits light with a second color temperature of 20%. After the two are mixed, the light emitting device 500 can emit a third color temperature, for example, 3000K.

The light emitting device 500 can perform multiple other color temperatures, the working process and principle are basically the same as the above three color temperature changes, so they will not be repeated here.

Figure 3:
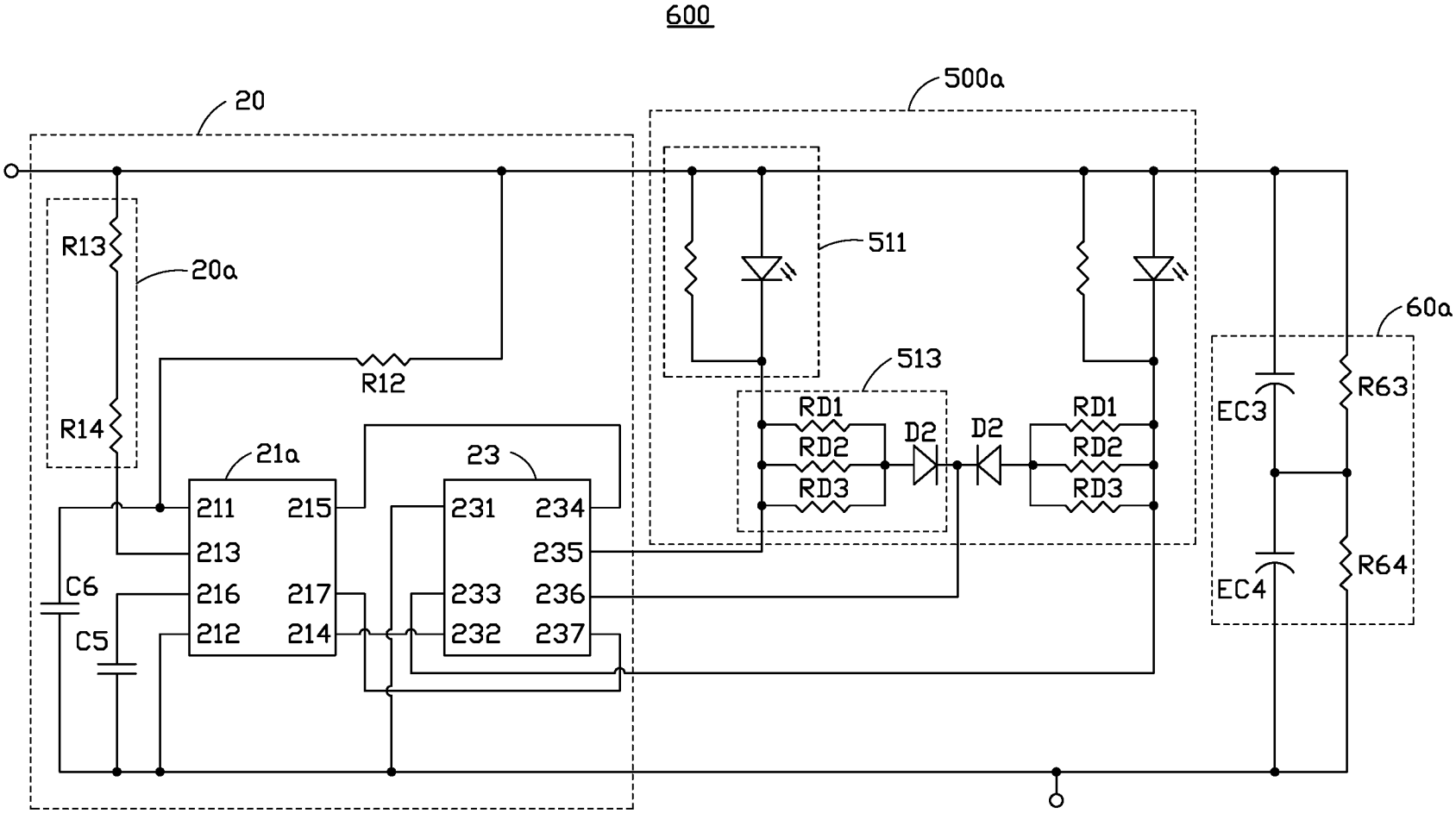
FIG. 3 is a partial circuit diagram of the lighting device of FIG. 1.

Referring to FIG. 3, a circuit diagram of a lighting device 600 according to a second preferred embodiment is shown. The structure and working principle of the lighting device 600 are substantially the same as the lighting device 300, the difference is that the lighting device 600 can include a second control circuit 20*a*. The second control circuit 20*a* can include a second chip 21*a*, and a third chip 23. The second chip 21*a* can include a first regulator pin 216 and a third output pin 217. The third chip 23 can include a third power pin 231, a first input pin 232, a fourth output pin 233, a second input pin 234, a fifth output pin 235, a sixth output pin 236, and a third input pin 237.

In at least one embodiment, the second power pin 211 is electrically coupled to the AC voltage source through the twelve resistor R12. The detection pin 213 is electrically coupled to the AC voltage source through the thirteenth resistor R13 and the fourteenth resistor R14 which are coupled in series. The first output pin 214 is electrically coupled to the first input pin 232. The second output pin 215 is electrically coupled to the second input pin 234. The first regulator pin 216 is electrically coupled to the second ground pin 212 and the third power pin 231 via a fifth capacitor C5. The third output pin 217 is electrically coupled to the third input pin 237. The fourth output pin 233, the fifth output pin 235 and the sixth output pin 236 are respectively electrically coupled to the light emitting device 500*a*. When the detection pin 213 detects that the AC voltage source is turned on within a predetermined period, the fourth output pin 233, the fifth output pin 235, and the sixth output pin 236 are triggered in sequence to output pulse signal for controlling the light emitting device 500*a* to emit light. By switching the input channels established by the fourth output pin 233, the fifth output pin 235, and the sixth output pin 236, the light emitting device 500*a* can perform three color temperatures. In this embodiment, the second power pin 211 is electrically coupled to the second ground pin 212 and the first voltage stabilizing pin 216 via a sixth capacitor C6. The sixth capacitor C6 can change the duration of the color temperature produced by the second control circuit 20. In this embodiment, if the duration of the color temperature is 0.5 seconds, the control method is that the AC voltage source is turned off for 0.5 seconds, and then the AC voltage source is turned on again. The color temperature of the light emitting device 500*a* will be produced before the light is turned off.

In at least one embodiment, the lighting device 600 also differs in that the lighting device 600 can include a light emitting device 500*a*. The light emitting device 500*a* can include two light emitting units, each of the two light emitting units can include a light emitting element 511 and an adjustment circuit 513. The adjustment circuit 513 can include a plurality of parallel adjustment resistors RD1, RD2, and RD3. One end of the adjustment circuit 513 is electrically coupled to the light emitting element 511, and the other end is electrically coupled to the third chip 23.

In at least one embodiment, the lighting device 600 also differs in that the lighting device 600 can include a first strobe protection device 60*a*, the second strobe protection device 70 is omitted. The first strobe protection device 60*a* can include a third protection resistor R63, a fourth protection resistor R64, a third polarized capacitor EC3, a fourth polarized capacitor EC4. The third protection resistor R63 and the fourth protection resistor R64 are coupled in series between the light emitting device 500*a* and the first control circuit 10. The third polarized capacitor EC3 is coupled in parallel to the third protection resistor R63 and the fourth polarized capacitor EC4 which are coupled in parallel to the fourth protection resistor R64.

In at least one embodiment, the control circuit 100 and the lighting devices 300 and 600 with the control circuit have both functions of adjusting brightness and color temperature. The control circuit 100 can detect whether the AC voltage source is on by the second control circuit 20, and control the changes of color temperature of the light emitting devices 500 and 500*a*, so that multiple color temperatures can be presented.

It should be emphasized that the above-described embodiments of the present disclosure, including any particular embodiments, are merely possible examples of implementations, set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. A control circuit electrically coupled to an AC voltage source and a light emitting device, and controls the light emitting device to emit light, the control circuit comprising:

a first control circuit, and a second control circuit;

wherein the first control circuit is electrically coupled to the light emitting device to turn on and turn off the light emitting device and adjusts brightness of the light emitting device;

wherein the second control circuit is electrically coupled to the light emitting device to determine whether the AC voltage source is on during a predetermined period, and adjust a color temperature of the light emitting device if the AC voltage source is determined to be on;

wherein the first control circuit comprises a first chip, a switch, a first adjusting device, and the first chip comprises a first power pin, a first grounded pin, a set pin and a gate input pin; wherein the first power pin is grounded through a first capacitor, the first ground pin is grounded, the gate input pin is electrically coupled to the light emitting device through the switch, and the gate input pin controls the light emitting device to turn on or off by the switch, the set pin is electrically coupled to the switch through the first adjusting device, and adjusts input current of the light emitting device by the first adjusting device;

wherein the switch comprises at least one first switch, a first terminal of the at least one first switch is electrically coupled to the gate input pin, and a second terminal of the at least one first switch is electrically coupled to the light emitting device, and a third terminal of the at least one first switch is grounded through the first adjusting device; when the at least one first switch is turned on, the light emitting device is turned on, and when the at least one first switch is turned off, the light emitting device is turned off; and wherein the first adjusting device comprises a first resistor, at least one second resistor each corresponding to one of the at least one first switch; and wherein one end of the first resistor is electrically coupled to the set pin, and the other end of the first resistor is grounded through the at least one second resistor, one end of each of the at least one second resistor of the at least one second resistor is electrically coupled to the corresponding one of the at least one first switch, and the other end of each second resistor of the at least one second is grounded.

2. The control circuit according to claim 1, wherein the first adjusting device adjusts brightness of the light emitting device by changing the input current of the light emitting device, and the input current of the light emitting device is changed by adjusting resistance of the at least one second resistor.

3. The control circuit according to claim 1, wherein the second control circuit comprises:

a second chip; and a detection device;

wherein the second chip comprises a second power pin, a second ground pin, a detection pin, a first output pin, and a second output pin;

wherein the second power pin is electrically coupled to a power source, and the second ground pin is grounded, and the detection pin is electrically coupled to the AC voltage source;

if the detection pin detects that a voltage value of the AC voltage source is equal to a predetermined value, the detection device sends a detection signal to the detection pin, and the detection signal triggers the first output pin to output a first pulse signal to the light emitting device, and the second output pin outputs a second pulse signal to the light emitting device.

4. The control circuit according to claim 3, wherein the detection device comprises:

a ninth resistor;

a tenth resistor;

a fifth capacitor, and a second switch;

wherein one end of the ninth resistor and tenth resistor coupled in series is electrically coupled to the AC voltage resource, and the other end is grounded; the fifth capacitor is electrically coupled in parallel to the tenth resistor; and a first terminal of the second switch is electrically coupled between the ninth resistor and the tenth resistor, a second terminal of the second switch is electrically coupled to the power source through an eleventh resistor, and electrically coupled to the detection pin through a twelve resistor, and a third terminal of the second switch is grounded, and if a voltage value of the AC voltage source is equal to the predetermined value, the second switch is turned on to send the detection signal to the detection pin.

5. The control circuit according to claim 4, wherein the light emitting device comprises two light emitting units, and each light emitting unit comprises a light emitting element and a switch circuit, and the switch circuit comprises a third switch; wherein a first terminal of the third switch is electrically coupled to the light emitting element, a second terminal of the third switch is electrically coupled to the second control circuit, and a third terminal of the third switch is grounded through the thirteenth resistor and is electrically coupled to the first control circuit simultaneously.

6. The control circuit according to claim 1, wherein the second control circuit comprises:

a second chip; and a third chip;

wherein the second chip comprises a second power pin, a second ground pin, a detection pin, a first output pin, a second output pin, a first regulator pin, and a third output pin;

wherein the third chip comprises a third power pin, a first input pin, a fourth output pin, a second input pin, a fifth output pin, a third input pin, and a sixth output pin;

wherein the second power pin is electrically coupled to the AC voltage source through the twelve resistor, and the detection pin is electrically coupled to the AC voltage source through the thirteenth resistor and the fourteenth resistor which are coupled in series, and the first output pin is electrically coupled to the first input pin, and the second output pin is electrically coupled to the second input pin, and the first regulator pin is electrically coupled to the second ground pin and the third power pin via a fifth capacitor, and the third output pin is electrically coupled to the third input pin, the fourth output pin, the fifth output pin and the sixth output pin are respectively electrically coupled to the light emitting device;

wherein if the detection pin detects that the AC voltage source is turned on within the predetermined period, the fourth output pin, the fifth output pin, and the sixth output pin are triggered in sequence to output pulse signals for controlling the light emitting device to emit light.

7. The control circuit according to claim 6, wherein the light emitting device comprises two light emitting units, and each of the two light emitting units comprises a light emitting element and an adjustment circuit; wherein the adjustment circuit comprises a plurality of parallel adjustment resistors, and one end of the adjustment circuit is electrically coupled to the light emitting element by a second diode and electrically coupled to the fifth output pin of the third chip, and the other end is electrically coupled to the sixth output pin of the third chip.

8. A lighting device comprising:

a light emitting device; and a control circuit which is electrically coupled to the light emitting device and an AC voltage source;

wherein the control circuit comprises:

a first control circuit, and a second control circuit;

wherein the first control circuit is electrically coupled to the light emitting device to turn on and turn off the light emitting device and adjust brightness of the light emitting device;

wherein the second control circuit is electrically coupled to the light emitting device to determine whether the AC voltage source is on during a predetermined period, and adjust color temperature of the light emitting device if the AC voltage source is determined to be on;

wherein the first control circuit comprises a first chip, a switch, a first adjusting device, and the first chip comprises a first power pin, a first grounded pin, a set pin and a gate input pin; wherein the first power pin is grounded through a first capacitor, the first ground pin is grounded, the gate input pin is electrically coupled to the light emitting device through the switch, and the gate input pin controls the light emitting device to turn on or off by the switch, the set pin is electrically coupled to the switch through the first adjusting device, and adjusts input current of the light emitting device by the first adjusting device;

wherein the switch comprises at least one first switch, a first terminal of the at least one first switch is electrically coupled to the gate input pin, and a second terminal of the at least one first switch is electrically coupled to the light emitting device, and a third terminal of the at least one first switch is grounded through the first adjusting device; when the at least one first switch is turned on, the light emitting device is turned on, and when the at least one first switch is turned off, the light emitting device is turned off; and wherein the first adjusting device comprises a first resistor, at least one second resistor which is corresponding to the at least one first switch; and wherein one end of the first resistor is electrically coupled to the set pin, and the other end of the first resistor is grounded through the at least one second resistor, one end of each second resistor of the at least one second resistor is electrically coupled to the corresponded at least one first switch, and the other end of each second resistor of the at least one second is grounded.

9. The lighting device according to claim 8, wherein the first adjusting device adjusts brightness of the light emitting device by changing the input current of the light emitting device, and the input current of the light emitting device is changed by adjusting resistance of the at least one second resistor.

10. The lighting device according to claim 8, wherein the second control circuit comprises:

a second chip; and a detection device;

wherein the second chip comprises a second power pin, a second ground pin, a detection pin, a first output pin, and a second output pin;

wherein the second power pin is electrically coupled to a power source, and the second ground pin is grounded, and the detection pin is electrically coupled to the AC voltage source;

if the detection pin detects that a voltage value of the AC voltage source is equal to a predetermined value, the detection device sends a detection signal to the detection pin, and the detection signal triggers the first output pin to output a first pulse signal to the light emitting device, and the second output pin outputs a second pulse signal to the light emitting device.

11. The lighting device according to claim 10, wherein the detection device comprises:

a ninth resistor;

a tenth resistor;

a fifth capacitor, and a second switch;

wherein one end of the ninth resistor and tenth resistor coupled in series is electrically coupled to the AC voltage resource, and the other end is grounded; the fifth capacitor is electrically coupled in parallel to the tenth resistor; and a first terminal of the second switch is electrically coupled between the ninth resistor and the tenth resistor, a second terminal of the second switch is electrically coupled to the power source through an eleventh resistor, and electrically coupled to the detection pin through a twelve resistor, and a third terminal of the second switch is grounded, and if a voltage value of the AC voltage source is equal to the predetermined value, the second switch is turned on to send the detection signal to the detection pin.

12. The lighting device according to claim 11, wherein the light emitting device comprises two light emitting units, and each light emitting unit comprises a light emitting element and a switch circuit, and the switch circuit comprises a third switch; wherein a first terminal of the third switch is electrically coupled to the light emitting element, a second terminal of the third switch is electrically coupled to the second control circuit, and a third terminal of the third switch is grounded through the thirteenth resistor and is electrically coupled to the first control circuit simultaneously.

13. The lighting device according to claim 8, wherein the second control circuit comprises:

a second chip; and a third chip;

wherein the second chip comprises a second power pin, a second ground pin, a detection pin, a first output pin, a second output pin, a first regulator pin, and a third output pin;

wherein the third chip comprises a third power pin, a first input pin, a fourth output pin, a second input pin, a fifth output pin, a third input pin, and a sixth output pin;

wherein the second power pin is electrically coupled to the AC voltage source through the twelve resistor, and the detection pin is electrically coupled to the AC voltage source through the thirteenth resistor and the fourteenth resistor which are coupled in series, and the first output pin is electrically coupled to the first input pin, and the second output pin is electrically coupled to the second input pin, and the first regulator pin is electrically coupled to the second ground pin and the third power pin via a fifth capacitor, and the third output pin is electrically coupled to the third input pin, the fourth output pin, the fifth output pin and the sixth output pin are respectively electrically coupled to the light emitting device;

wherein if the detection pin detects that the AC voltage source is turned on within the predetermined period, the fourth output pin, the fifth output pin, and the sixth output pin are triggered in sequence to output pulse signal for controlling the light emitting device to emit light.

14. The lighting device according to claim 13, wherein the light emitting device comprises two light emitting units, and each of the two light emitting units comprises a light emitting element and an adjustment circuit; wherein the adjustment circuit comprises a plurality of parallel adjustment resistors, and one end of the adjustment circuit is electrically coupled to the light emitting element by a second diode and electrically coupled to the fifth output pin of the third chip, and the other end is electrically coupled to the sixth output pin of the third chip.

* * * * *